United States Patent [19]

Anderson

[11] Patent Number: 4,534,258

[45] Date of Patent: Aug. 13, 1985

[54] TRANSDUCING ASSEMBLY RESPONSIVE TO STRING MOVEMENT IN INTERSECTING PLANES

[76] Inventor: Norman J. Anderson, 2 Schmitt La., Flanders, N.J. 07036

[21] Appl. No.: 538,526

[22] Filed: Oct. 3, 1983

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,964,985 | 12/1960 | Webster | 84/1.15 |
| 2,976,755 | 3/1961 | Fender | 84/1.16 |
| 3,453,920 | 7/1969 | Scherer | 84/1.16 |
| 3,588,311 | 6/1971 | Zoller | 84/1.15 |
| 4,143,575 | 3/1979 | Oliver | 84/1.16 |
| 4,188,849 | 2/1980 | Rickard | 84/1.15 |
| 4,201,108 | 5/1980 | Bunker | 84/1.16 |
| 4,348,930 | 9/1982 | Chobanian et al. | 84/1.15 |
| 4,408,513 | 10/1983 | Clevinger | 84/1.15 |

*Primary Examiner*—Stanley J. Witkowski

*Attorney, Agent, or Firm*—Baker, Maxham, Callan & Jester

[57] ABSTRACT

A transducing assembly for a musical instrument responsive to string movement in intersecting, preferably perpendicular, planes for producing two electrical signals that can be processed and/or combined and then reproduced by a plurality of loudspeakers to yield an enhanced quality of sound.

18 Claims, 11 Drawing Figures

TRANSDUCING ASSEMBLY RESPONSIVE TO STRING MOVEMENT IN INTERSECTING PLANES

BACKGROUND OF THE INVENTION

This invention concerns transducers for converting the string vibrations of a musical instrument into electrical signals.

DESCRIPTION OF THE PRIOR ART

The most common musical instrument that employs transducers for producing electrical signals for string vibrations is the electric guitar. A well-known transducer is a reluctance type of pick-up comprising a plurality of permanently magnitized cores, one core positioned beneath each string, and conductive coil associated with all the cores. At least a portion of the cross-section of each string is magnetically permeable; consequently string movement toward or away from an adjacent magnetized core alters the reluctance of the magnetic field surrounding the core and hence varies the flux threading the coil. This flux variation induces in the coil an electrical signal that is amplified and supplied to a loudspeaker.

It is known that a plucked or deflected string does not continue to vibrate in the plane of its initial deflection, but the plane of vibration has a tendency to rotate in an uncontrollable manner. This produces a tremulo or pulsating electrical signal because the sensitivity of the transducer differs according to the plane of string vibration. In an attempt to minimize this effect, a core has been employed on each side of each string, for a total of one more core than the number of string. However, the flux decreases with respect to one core as it increases with respect to the adjacent core in response to horizontal string movement, thus cancelling the fundamental horizontal tone in the common coil.

SUMMARY OF THE INVENTION

The present invention arises from a recognition that all transverse motion of a taut string is musically valuable. Furthermore, it has been found that the movement of a point on a string tends to describe a complicated Lissajous figure in the transverse plane rather than merely a slowly rotating straight line.

In accordance with the invention, two transducers are provided responsive to movements of a vibratory string in intersecting planes for producing two electrical signals. These signals may be processed to derive all the musically valuable vibratory movement of the string, which may be reproduced by two or more speakers to yield an enhanced richness of sound.

More specifically, an operating field of flux is established, and a pair of transducers are positioned in the field responsive to string movement, the spatial relationship between the string and the transducers effecting a flux distribution of the field such that an electrical signal is produced by one of the transducers in response to string movement at an angle, preferably perpendicular, to the string movement that produces an electrical signal by the other of said transducers.

DETAILED DESCRIPTION OF A PREFERRED EMBODIMENT

The transducing assemblies chosen for illustration are associated with an electric guitar that is especially suitable for producing improved sound. However, it will be shown that the transducing assembly can be easily attached to existing guitars having different string spacings.

Figure 1:
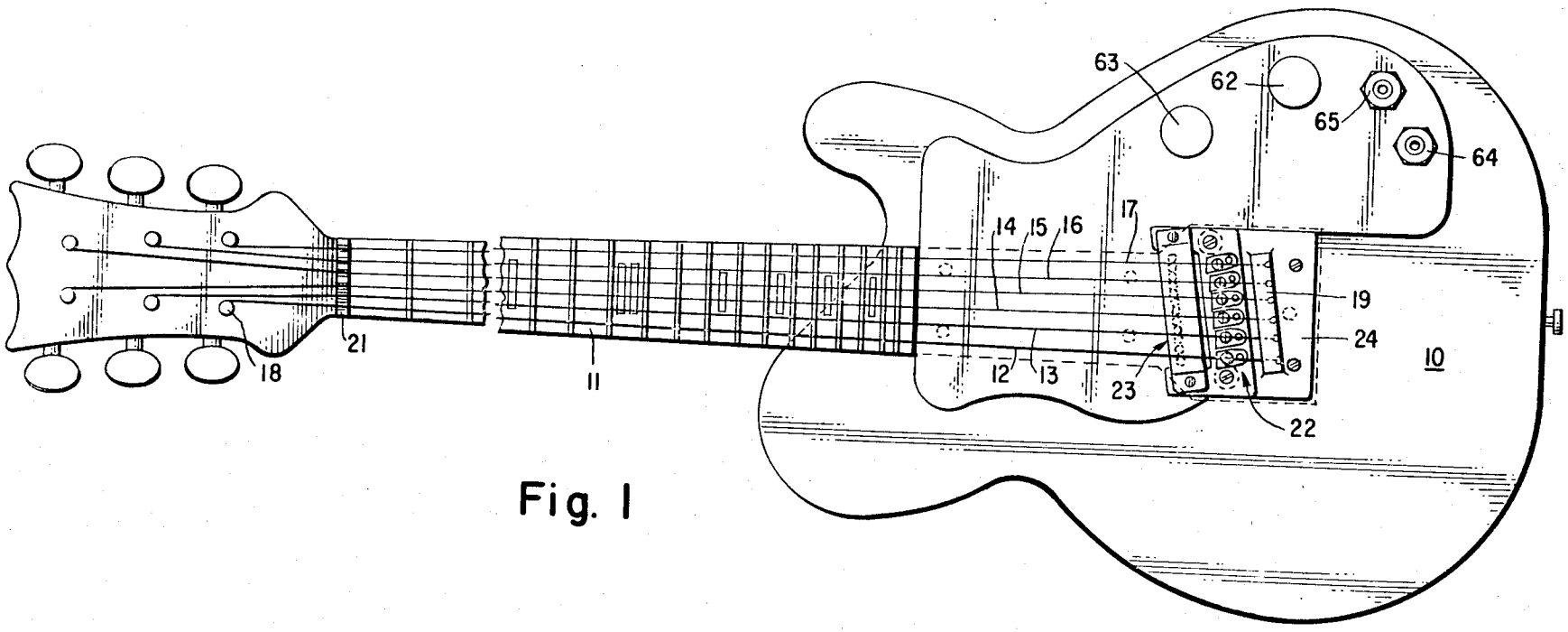
FIG. 1 is a view of the top surface of an electric guitar embodying the new transducing assembly.
Figure 2:
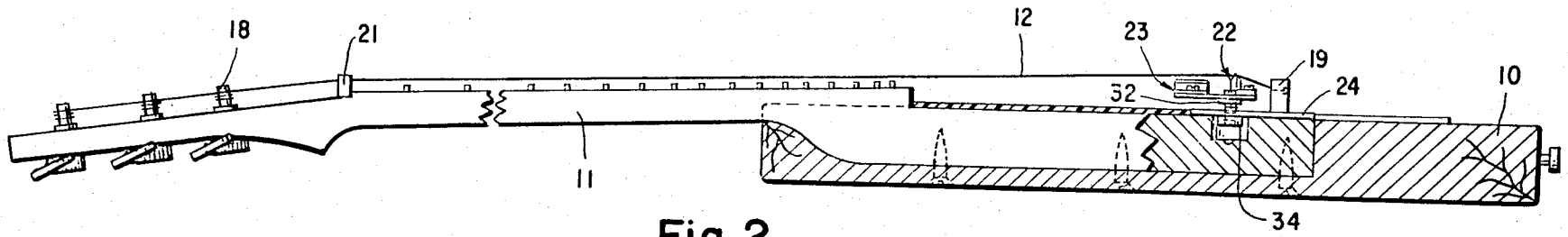
FIG. 2 is a side view of the guitar shown in FIG. 1, a portion of the guitar body being cut away.

Referring to the drawings and particularly to FIGS. 1 and 2, an electric guitar is illustrated comprising a body 10, a fretted neck 11, and a plurality of generally parallel magnetically permeable strings 12–17 tensioned between tuning pegs 18 at the outer end of the neck 11 and a string anchor 19 on the inner end of the neck 11, which inner end is detachably embedded in the body 10. The free vibratory length of each string is determined by the spacing between a ridge or nut 21 near the outer end of the neck 11 and a bridge 22 on the inner end, which together support the strings transversely of their length. A transducing assembly 23 for producing electrical signals in response to transverse string movements is mounted close to the bridge 22 between the strings 12–17 and the body 10.

Figure 3:
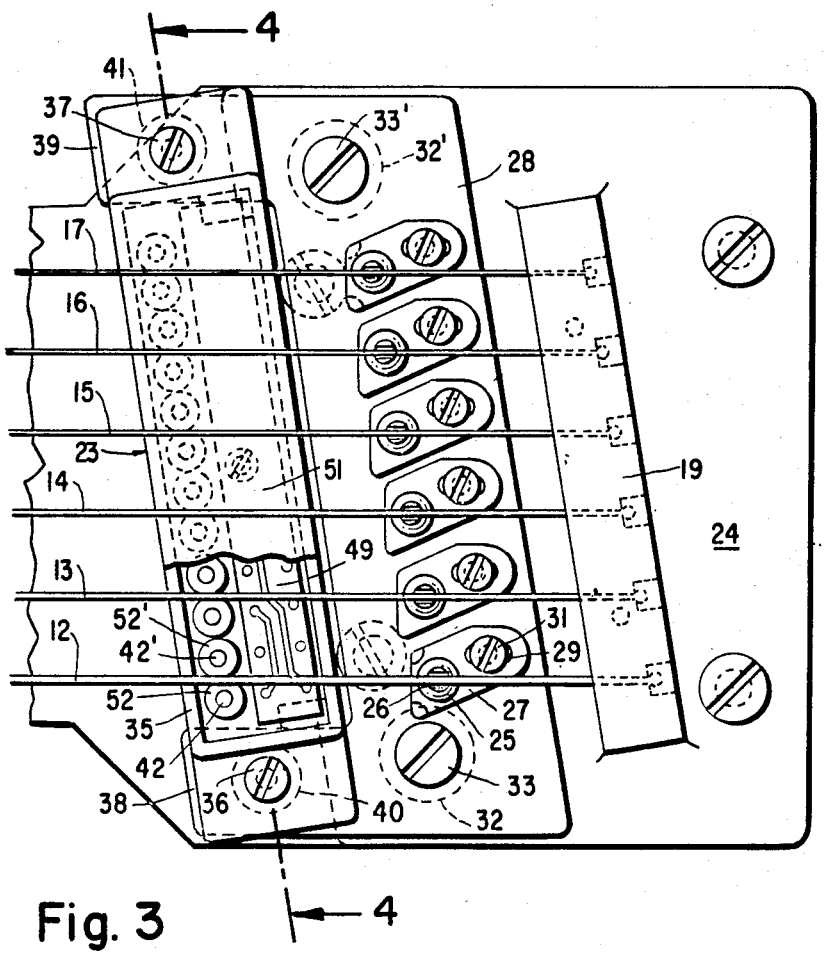
FIG. 3 is a view of a portion of the top surface of the guitar on an enlarged scale showing details of the new transducing assembly, bridge and string anchor.

The bridge, shown in greater detail in FIG. 3, provides each string with individual support permitting limited independent adjustment along the string and adjustment as a whole toward or away from a base plate 24 to which the string anchor 19 is fixed. Typically, a stud 25 having a groove 26 containing the string 12 projects perpendicularly from a flat lug 27 attached to a bridge plate 28 that lies parallel to the base 24. An attachment screw 31 passing through a slot 29 in the lug 27 permits slight adjustment of the stud 25 toward or away from the anchor 19. The bridge plate 28 carrying all the studs 25 is pressed by the strings 12–17 against collars 32 and 32′ formed on screws 33 and 33′, respectively, which engage nuts 34 (see FIG. 2) fixed to under side of the base plate 24.

Figure 4:
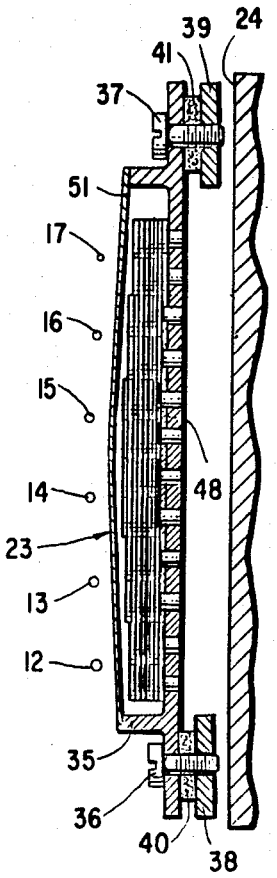
FIG. 4 is a cross-sectional view of the new transducing assembly taken along dashed line 4—4 of FIG. 3 perpendicular to the longitudinal axes of the strings.

The transducing assembly 23, shown perpendicularly in FIGS. 3 and 4, comprises a generally rectangular transducer holder 35 attached by means of screws 36 and 27 to arms 38 and 39, respectively, extending in the direction of the guitar neck 11 from the bridge plate 28. The mounting of the transducing assembly 23 on the bridge plate 28 permits adjustment of the desired actions or fret clearance without disturbing the spatial relationship between the transducing assembly and the strings. Resilient washers 40 and 41 between the holder 35 and the arms 38 and 39, respectively, permit limited adjustment of the spacing between the transducing assembly 23 and the string 12–17. Pairs of permanently magnetized cylindrical cores 42, 42'–47, 47' are mounted in the holder 35 in a straight line substantially parallel to the line of bridge studs 25. The central axes of the cores are directed perpendicularly to the bridge plate 28. Each pair of the cores 42, 42'–47, 47' is positioned in straddling relationship to the strings 12–17, respectively. For example, the string 12 lies equidistant the projected central axes of the cores 42 and 42'. The cores, which may be made of sintered Alnico 8, are magnetized along their central axes in a sense to create similar poles at adjacent ends. Thus, the pairs of cores 42, 42'–47, 47' establish operating fields of flux in which the strings 12–17, respectively, are immersed.

Solenoidal coils 52, 52'–57, 57' surround cores 42, 42'–47, 47', respectively. A typical coil 52 comprises multiple turns of insulated electrically conductive wire wound on a bobbin (not explicitly shown) that slips over the core 42. Since the strings 12–17 lie in a slightly curved surface rather than in a plane, spacers 48 are provided between the coil and core units and the transducer holder 35 as necessary to accommodate this curvature. A terminal board 49 within the holder 35 provides the interconnection of the coils schematically shown in FIG. 5. A non-magnetic cover 51 on the holder protects its contents.

Figure 5:
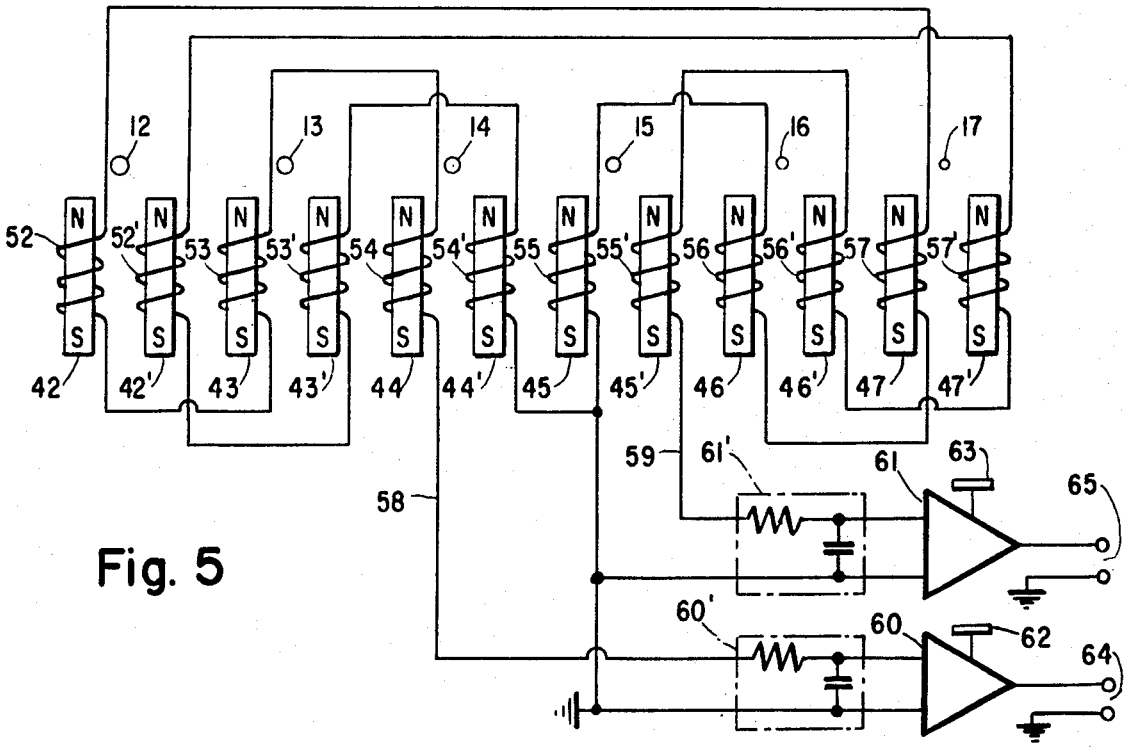
FIG. 5 is a schematic wiring diagram of the transducing assembly.

Referring to FIG. 5, the coils 52–57 are connected in series with the polarities of the windings chosen to balance the turns of one polarity against an equal number of turns of the opposite polarity for effective cancellation of external fields or hum bucking. Similarly, coils 52'–57' are connected in series with polarities arranged for optimum hum bucking. The small size of the coils contributes to the excellent rejection of hum fields. The signals induced in coils 52–57 and 52'–57' are supplied over leads 58 and 59, respectively, to preamplifiers 60 and 61, respectively, having volume controls 62 and 63, respectively, and output jacks 64 and 65, respectively. The jacks, volume controls, and their electronic parts and connections are preferably incorporated in the body 10, whereas the strings and transducer assembly are carried as a unit by the neck.

The operation of the transducing assembly can be understood from a consideration of the interaction between a typical string 12, the straddling permanent magnetic cores 42 and 42'. and the associated coils 52 and 52', respectively. The spatial relationship between the string 12 and the cores 42 and 42' effects a magnetic flux distribution such that a maximum electrical signal is induced in the coil 52 in response to string movement substantially perpendicular to the string movement that induces a maximum electrical signal in the coil 52'. However, it is sufficient that the planes of string movement producing maximum signals in the coils 52 and 52' intersect in order to determine all the transverse movements of the string 12. The components of string motion represented by the signals from the coils 52 and 52', called for convenience X motion and Y motion, respectively, and appearing at jacks 64 and 65, respectively, are +45 degrees and −45 degrees with respect to the top surface of the guitar body 10.

The output signals at the jacks 64 and 65 are normally further separately amplified and reproduced by individual loudspeakers (not shown). However, the two signals channels can be processed and combined to obtain two or more modified channels, each representing a desired component of string movement. For example, the output signals can be added and subtracted to sense horizontal and vertical movement, respectively, of the string. Alternatively or additionally, the output signals can be phase or time shifted relative to each other and combined to represent clockwise and counterclockwise components of string movement. Thus, the transducing assembly 23 derives all musically valuable vibratory movement of the string to yield an enhanced richness of reproduced sound.

The transducing assembly 23 is mounted in the "back" position close to the bridge 22. The "back" position is advantageous because the string amplitudes are small relative to the spacing between the strings. In accordance with the present invention, the transducers are mounted less than a quarter of a harmonic wavelength of the vibratory string from the bridge. In general, the higher the harmonic selected for "back" positioning the transducing assembly, the more complete the response, consistent, however, with the ultimate sensitivity of the transducing assembly. Excellent results can be achieved, for example, using the sixth harmonic of the highest frequency string. This position permits close spacing of the cores to the strings and allows each coil to be selectively responsive to its associated string. All frequency components of string motion must have zero amplitude at the bridge 22, and the nearest antinode or point of maximum amplitude of a string vibration for both the fundamental and the harmonics moves closer to the bridge in proportion to the decrease in its wavelength and increase in its frequency. Accordingly, the transducing assembly 23 tends to respond primarily to high frequencies. However, to compensate for this effect, the components of the signals appearing on leads 58 and 59 are amplified by preamplifiers 60 and 61, respectively, in inverse relationship to their frequencies to provide output signals at jacks 64 and 65, respectively, corresponding to the antinodes of the fundamental and harmonic string vibrations. Integrating circuits 60' and 61', respectively, are incorporated in the preamplifiers 60 and 61 for this purpose. Thus, the output signals correspond closely to the actual antinodal motions of the strings in the intersecting planes of maximum transducer sensitivity.

The wavelength associated with a particular frequency is the same whether the vibration is a harmonic of the open string or a fundamental of the fretted string. However, the wavelength corresponding to a given frequency is different on different strings. Accordingly, the antinode of a vibration nearest the transducing assembly on one string has spacing different from that of the corresponding antinode of a vibration of identical frequency on another string. Therefore, the response of the transducing assembly 23 would be unequal for equally strong vibrations of identical frequency on different strings in the absence of some compensating effect.

The relative response of the transducing assembly 23 to the different strings is affected by the magnetic bulk of the strings and their distance from the transducing assembly. The relative response can also be adjusted by altering the turn ratio of the pairs of coils 52, 52'–57, 57' and/or the relative strength of the pairs of cores 42, 42'–47, 47'. The transducing assembly is suitable for either bronze-wrapped or nickel alloy strings because the turns of the coils can be chosen to match the characteristics of the strings.

When the transducing assembly 23 is attached to existing guitars, the spacing between the pairs of cores 42, 42'-47, 47' is predetermined to fit the widest commercially accepted string spacing. Guitars having narrower string spacings are accommodated by positioning the transducer holder 35 at a slight angle to the bridge 22 to center the strings between their associated cores. This change alters the relative responses of the pairs of coils 52, 52'-57, 57' because the response of a coil pair is directly proportional to its distance to the common nodal point at the bridge 22. The response can be restored to equality by slightly increasing the perpendicular distance to the string of the coil pair that is furthest from the bridge or slightly reducing the perpendicular distance to the string of the coil pair that is nearest the bridge.

Figure 6:
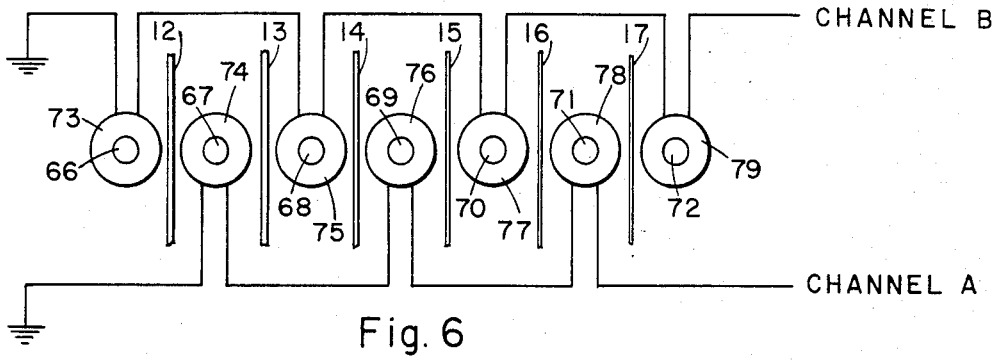
FIG. 6 is a schematic diagram of an alternate embodiment.

It is not essential to employ a separate pair of cores and coils for each string in order to derive the benefits of the invention. It is sufficient to employ one more core and coil than the number of strings and provide a single core and coil between each one of the strings 12-17 common to the adjacent two strings. For example, as shown in FIG. 6, a common core 67 and coil 74 between strings 12 and 13 can replace cores 42' and 43 and coils 52' and 53. This one coil is responsive to the Y motion of string 12 and the X motion of string 13. Likewise, a second common core 68 and coil 75 between strings 13 and 14 can replace cores 43' and 44 and coils 53' and 54. This second common coil 74 is responsive to the Y motion of string 13 and the X motion of string 14. In a similar manner, common cores 69, 70 and 71 and associated coils 76, 77 and 78 are provided between strings 14 and 15, 15 and 16, and 16 and 17 responsive to string motions 14Y and 15X, 15Y and 16X, and 16Y and 17X, respectively. Additional cores 66 and 72 and associated coils 73 and 79 are placed adjacent and outside strings 12 and 17. Accordingly, signals corresponding to string motions 12X, 13Y, 14X, 15Y, 16x and 17Y are supplied to one output channel, and signals corresponding to string motions 12Y, 13X, 14Y, 15X, 16Y and 17X are supplied to the second output channel. This simplified arrangement equalizes the volumes of sound in the two channels irrespective of the direction in which the strings are initially plucked or deflected.

Note also that the coils are small enough to be positioned in a straight line transverse or substantially at 90 degrees to the axis of the strings.

Figure 7:
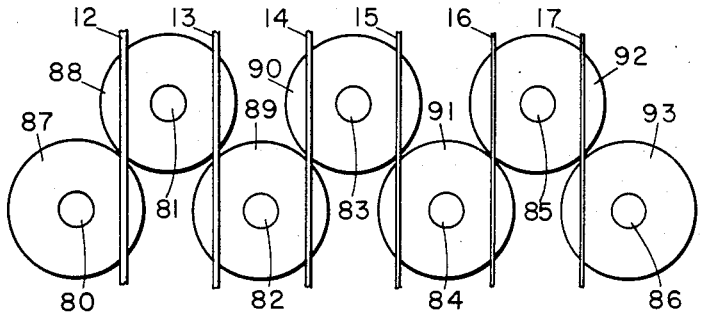
FIG. 7 is a schematic diagram of another embodiment.
Figure 8:
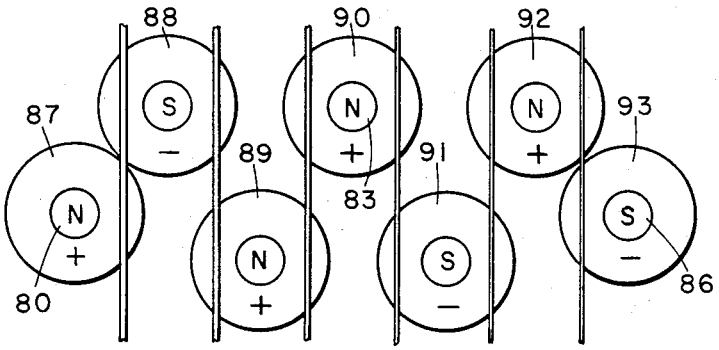
FIG. 8 is a schematic diagram of the embodiment of FIG. 7 showing specific polarity.
Figure 9:
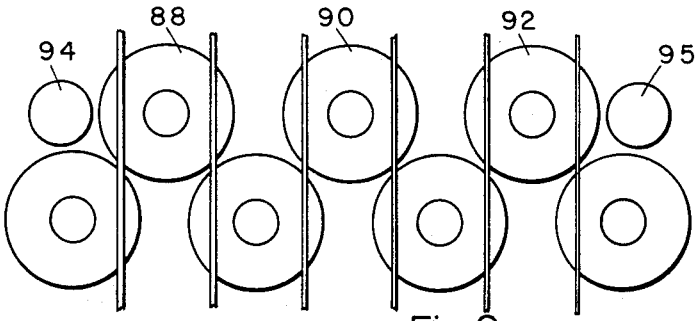
FIG. 9 is a schematic diagram of the embodiment of FIG. 7 including dummy pickups.

Referring to FIGS. 7-9, a still further embodiment is illustrated wherein the coils are larger to enhance the sensitivity of the pick up. The larger diameter coils are staggered in order to accommodate their position between the string. This staggering of the coils could provide a coil essentially double in diameter with larger and longer core magnets used. The coils in this arrangement are more sensitive to all positions of the adjacent strings, making the location of the core and coil itself less critical. In this embodiment (as illustrated in FIG. 7), a series of cores 80-86 and associated coils 87-92 are positioned in two substantially parallel rows. Cores 81-85 are positioned between the strings with cores 80 and 86 positioned outside of strings 12 and 17. This arrangement of top and bottom rows are positioned closely together to save space.

I have found through experimentation that with variations of this arrangement the polarity of the magnets can be critial. The diagonal magnets must be poled opposite for best results. Alternatively, the magnets can be moved further from each other along the string to achieve a better output.

At least one pair of the diagonal magnets must be poled the same way in order to obtain vertical add as well as hum buck. Therefore, at least one coil must be moved away from its like poled coil.

Referring to FIG. 8 a preferred polarity and positioning of the coils for the N plus one version (N being the number of strings) is illustrated.

In the illustrated embodiment, diagonal magnets 82 and 83 are poled the same way, therefore, vertical add is obtained. Therefore coil 89 is moved down out of alignment with the axis of magnets 80 and 86. We then have the option of moving the coil 91 down solely for the purpose of symmetry with the coil 89 and this can have an advantage of making room for wiring in the center regions between the coils. As a matter of actuality, all coils in the bottom row could be moved down except for the additional space required for the coils. The illustrated arrangement provides a spacing that permits the array of coils to be fitted into most available guitars.

Figure 10:
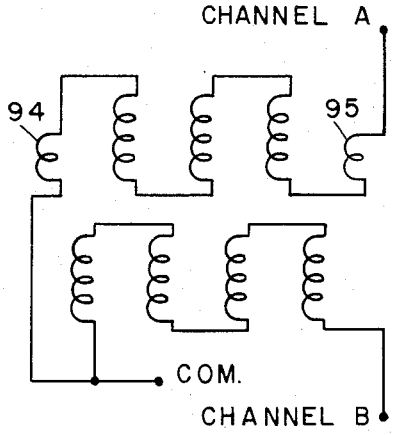
FIG. 10 is a wiring diagram of the FIG. 9 arrangement.

Turning to FIGS. 9 and 10, an arrangement is provided for improving and completing the hum buck of the channel B arrangement of this embodiment. In this arrangement, a pair of air core dummy coils 94 and 95 are added in series with the B channel coils 88, 90 and 92 to effect a total hum buck. The coils are wound in the same sense with the upper terminals finish leads.

Figure 11:
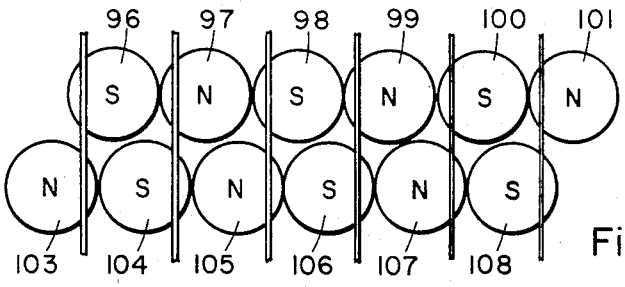
FIG. 11 is a schematic diagram of a further embodiment.

Referring to FIG. 11, an alternate embodiment of cores and coils are illustrated having two coils for each string. In this embodiment this can be referred to as the two-n stagger arrangement wherein an upper row of core and coil combinations 96-101 are positioned in transverse alignment to the strings 12-17. These are positioned as can be clearly seen in FIG. 11 slightly to one side of the strings so that each one is positioned closer to one string than another. A second row of magnet and coil combinations 103-108 are positioned below the previously described row and staggered or offset to essentially the opposite side of the respective strings 12-17. Thus, as seen in this arrangement, opposite poled transducing units are positioned staggered to each side of each string with one to one side of the string, the other to the other side of the string and offset along the axes of the respective strings. The arrangement provides the desirable vertical add as well as hum buck. For vertical add the coils for any one string are poled so that the outputs of the left and right channels, A and B channels, add for vertical motion of the string. This was found to be important when the left and right outputs were strapped together for monophonic use. The pick ups must operate well as a mono pick up such as for radio and television.

It is to be further understood that the invention is not limited to transducers responsive to the velocity of the strings, but it can be realized with displacement transducers responsive to the amplitudes of string movement.

I have taught the virtue of sensing very near the bridge and processing the signals. However, as a practical matter for many uses, adequate performance can be had by placing the transducers further from the bridge, achieving greater level, obviating the need for harmonic processing and pre-amplifiers.

While I have illustrated my invention by means of specific embodiments, it is to be understood that numerous changes and modifications may be made therein without departing from the spirit and scope of the invention as defined in the appended claims.

What is claimed is:

1. A transducing assembly for a musical instrument having magnetically permeable strings held under tension between a pair of supports, comprising:

a first reluctance type transducer positioned on one side of said string, and responsive to the component of movement of the string in a first plane for producing a first electrical signal, a second reluctance type transducer positioned on the other side and displaced longitudinally along said string from said first transducer, and responsive to the component of movement of the string in the second plane at a predetermined angle to said first plane for producing a second electrical signal, a pair of audio channels, and an independent output circuit connected to each of said transducers for supplying each of said signals to a respective channel.

2. The transducing assembly of claim 1 wherein said transducers are oppositely poled.

3. The transducing assembly of claim 1 wherein said transducers are positioned and poled to achieve vertical add and hum bucking.

4. The transducing assembly according to claim 1 wherein said transducers are positioned less than a quarter of a harmonic wave length of the vibratory string from one of its supports, and further comprising means for amplifying said signals to render the amplitude of the fundamental thereof, relative to the amplitude of the harmonic, proportional to the inverse ratio of their respective frequencies to provide electrical signals corresponding to the points of maximum amplitude of the fundamental and harmonics of the string vibrations in divergent planes.

5. The transducer assembly of claim 1 wherein said transducers equal twice the number of strings and said transducers are positioned in two rows extending transverse to the axis of the strings, and transducers are paired one from each row on opposite sides of each string.

6. The transducer assembly of claim 1 wherein said transducers equal twice the number of strings and said transducers are positioned transverse to the axis of the strings, and said transducers are paired on opposite sides of each string.

7. The transducing assembly of claim 1 wherein said assembly comprising a plurality of vibratory strings and the number of transducers comprise one more than the number of strings.

8. The transducing assembly of claim 7 wherein each of said transducers comprise a permanent magnet core and a coil wound about said core, wherein the coils of the transducers in each of said channels are connected in series.

9. A transducing assembly for a musical instrument having a plurality of magnetically permeable vibratory strings held under tension between a pair of supports, comprising:

an array of reluctance type transducers equal to one greater than the number of said strings arranged in pairs for each string and disposed on opposite sides of each of said strings, each of said pairs comprising:

a first transducer for each of said strings responsive to the component of movement of the string in a first plane for producing a first electrical signal, and a second transducer for each of said strings responsive to the component of movement of the string in the second plane at a predetermined angle to said first plane for producing a second electrical signal;

a pair of audio channels; and an independent output circuit connected to each of said first and second transducers for supplying each of said signals to a respective channel.

10. The transducing assembly of claim 9 wherein said transducers are staggered with one on each side of a line at a right angle.

11. The transducing assembly of claim 10 wherein said transducers are positioned and pole-oriented to obtain vertical adding and to provide hum bucking.

12. The transducing assembly of claim 11 wherein said strings are six in number and said transducers are seven in number.

13. The transducing assembly of claim 9 wherein said transducers are arranged in two rows transverse to the longitudinal axis of the strings.

14. The transducing assembly of claim 13 wherein transducers having like polarity positioned on opposite sides of a string are separated a greater distance along the length of said string than transducers having opposite polarity positioned along a string.

15. The transducing assembly according to claim 9 wherein said transducers are positioned less than a quarter of a harmonic wave length of the vibratory string from one of its supports, and further comprising means for amplifying said signals to render the amplitude of the fundamental thereof, relative to the amplitude of the harmonic, proportional to the inverse ratio of their respective frequencies to provide electrical signals corresponding to the points of maximum amplitude of the fundamental and harmonics of the string vibrations in divergent planes.

16. The transducing assembly of claim 9 wherein said strings are six in number and said transducers are seven in number, said transducers are arranged in two rows of three and four respectively transverse to the longitudinal axis of the strings; and a pair of dummy cells connected in the row of three transducers for providing hum bucking.

17. The transducing assembly of claim 13 wherein said transducers comprise a permanent magnet core and a coil surrounding said core, and the coils in a respective channel are connected in series.

18. The transducing assembly of claim 17 wherein at least one coil in each channel is wound opposite in polarity to a plurality of other coils in said channel.

* * * * *